US011788454B2

(12) United States Patent
Alano et al.

(10) Patent No.: US 11,788,454 B2
(45) Date of Patent: Oct. 17, 2023

(54) FLOW DIVERTER FOR HIGH EFFICIENCY MIXER

(71) Applicant: Faurecia Emissions Control Technologies, USA, LLC, Columbus, IN (US)

(72) Inventors: Eduardo Alano, Columbus, IN (US); Randall Cvelbar, Columbus, IN (US); Amaresh Rakkasagi, Bengaluru (IN); Anthony Burnett, Freetown, IN (US); Jerome Hornback, Indianapolis, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 229 days.

(21) Appl. No.: 17/101,557

(22) Filed: Nov. 23, 2020

(65) Prior Publication Data

US 2022/0162976 A1 May 26, 2022

(51) Int. Cl.

| | |
|---|---|
| ***F01N 3/28*** | (2006.01) |
| ***F01N 3/20*** | (2006.01) |
| ***F01N 13/18*** | (2010.01) |

(52) U.S. Cl.

CPC ..... *F01N 3/2892* (2013.01); *F01N 3/2053* (2013.01); *F01N 3/2066* (2013.01);

(Continued)

(58) Field of Classification Search

CPC .... F01N 3/2892; F01N 3/2053; F01N 3/2066; F01N 13/1844; F01N 2240/20;

(Continued)

(56) References Cited

U.S. PATENT DOCUMENTS

| | | | |
|---|---|---|---|
| 8,899,026 | B2 | 12/2014 | Loman et al. |
| 8,915,069 | B2 | 12/2014 | Loman |

(Continued)

FOREIGN PATENT DOCUMENTS

| | | | | |
|---|---|---|---|---|
| CN | 106523092 | A * | 3/2017 | ..... F01N 3/2066 |
| CN | 111727083 | A | 9/2020 | |
| DE | 102009036511 | A1 | 2/2011 | |
| DE | 102016210539 | B3 | 10/2017 | |

(Continued)

OTHER PUBLICATIONS

U.S. Appl. No. 16/834,182, filed Mar. 30, 2020.

First Examination Report for Indian Patent Application No. 202114052518 dated Jun. 16, 2022.

*Primary Examiner* — Devon C Kramer

*Assistant Examiner* — Kelsey L Stanek

(74) *Attorney, Agent, or Firm* — Carlson, Gaskey & Olds, P.C.

(57) ABSTRACT

A mixer assembly for a vehicle exhaust system includes a mixer shell defining an internal cavity, wherein the mixer shell includes an upstream end configured to receive exhaust gases and downstream end. A reactor is positioned within the internal cavity and has a reactor inlet configured to receive injected fluid and a reactor outlet that directs a mixture of exhaust gas and injected fluid into the internal cavity. A flow diverter is associated with the reactor to direct exhaust gas bypassing the reactor to mix with the mixture exiting the reactor outlet prior to exiting the downstream end of the mixer.

26 Claims, 4 Drawing Sheets

(52) U.S. Cl.
CPC ..... *F01N 13/1844* (2013.01); *F01N 2240/20* (2013.01); *F01N 2410/00* (2013.01)

(58) Field of Classification Search
CPC ..... F01N 2410/00; F01N 2610/00; F01N 2470/02; F01N 3/208; F01N 3/021; F01N 2610/02; F01N 2610/08; F01N 2610/1453; F01N 2610/1406; F01N 13/009; F01N 13/0097; F01N 13/14; F01N 2470/06; F01N 2470/08; F01N 2570/14; B01D 53/9431; B01D 53/9477; B01F 5/0688; B01F 5/0065; B01F 5/0471; B01F 5/0606; B01F 2005/0081; B01F 2005/0017
USPC ..... 60/324
See application file for complete search history.

(56) References Cited

U.S. PATENT DOCUMENTS

| | | | | |
|---|---|---|---|---|
| 9,784,163 | B2 | 10/2017 | Noren, IV et al. | |
| 9,925,502 | B2 | 3/2018 | De Rudder et al. | |
| 10,287,948 | B1 * | 5/2019 | Moulieres | B01F 25/4521 |
| 11,193,412 | B2 * | 12/2021 | Cvelbar | F01N 3/208 |
| 11,208,935 | B2 * | 12/2021 | Kurpejovic | B01F 25/3141 |
| 11,230,958 | B2 * | 1/2022 | Tucker | B01F 25/4233 |
| 2017/0082007 | A1 * | 3/2017 | Alano | F01N 3/2066 |
| 2020/0131969 | A1 | 4/2020 | Tucker et al. | |
| 2020/0269189 | A1 * | 8/2020 | Alano | F01N 3/2066 |

FOREIGN PATENT DOCUMENTS

| | | | |
|---|---|---|---|
| WO | 2011147556 | A1 | 12/2011 |
| WO | 2014098728 | A1 | 10/2015 |

* cited by examiner

FLOW DIVERTER FOR HIGH EFFICIENCY MIXER

TECHNICAL FIELD

This disclosure relates generally to an exemplary compact mixer configuration that provides a flow diverter to reduce deposition formation while maintaining a high mixing performance.

BACKGROUND

An exhaust system includes catalyst components to reduce emissions. The exhaust system includes an injection system that injects a diesel exhaust fluid (DEF), or a reducing agent such as a solution of urea and water for example, upstream of a selective catalytic reduction (SCR) catalyst which is used to reduce NOx emissions. The injection system includes a doser that sprays the fluid into an exhaust gas stream. A mixer is positioned upstream of the SCR catalyst to mix engine exhaust gases with the injected fluid. It is challenging to configure the plurality of exhaust system components within available packaging space. Compact mixer configurations allow for more efficient packaging but need to maintain high mixing performance while limiting deposit formation.

SUMMARY

An assembly according to an exemplary aspect of the present disclosure includes, among other things, a mixer shell defining an internal cavity, wherein the mixer shell includes an upstream end configured to receive exhaust gases and downstream end. A reactor is positioned within the internal cavity and has a reactor inlet configured to receive injected fluid and a reactor outlet that directs a mixture of exhaust gas and injected fluid into the internal cavity. A flow diverter is associated with the reactor to direct exhaust gas bypassing the reactor to mix with the mixture exiting the reactor outlet prior to exiting the downstream end of the mixer.

In a further non-limiting embodiment of the foregoing assembly, an inlet baffle is mounted to the upstream end of the mixer shell, the inlet baffle including at least one opening that directs exhaust gas into at least one exhaust gas inlet to the reactor and a plurality of bypass openings that direct exhaust gas to bypass entry into the reactor.

In a further non-limiting embodiment of any of the foregoing assemblies, an outlet baffle is mounted to the downstream end of the mixer shell, the outlet baffle including a plurality of mixer outlet openings.

In a further non-limiting embodiment of any of the foregoing assemblies, the reactor inlet defines an injection axis and the reactor outlet comprises a plurality of openings that are circumferentially spaced apart from each other about the injection axis, and wherein the reactor has a first end at the reactor inlet and extends along the injection axis to a second end comprising a bowl portion to define an open mixing chamber within the reactor between the first and second ends.

In a further non-limiting embodiment of any of the foregoing assemblies, the reactor comprises a conical shape having a larger cross-section at the second end than at the first end, and wherein the bowl portion comprises a solid surface that faces the reactor inlet.

In a further non-limiting embodiment of any of the foregoing assemblies, at least one attachment interface is between the flow diverter and the bowl portion.

In a further non-limiting embodiment of any of the foregoing assemblies, the flow diverter extends at least partially around the injection axis to surround at least a portion of the bowl portion, and including gaps between an outer surface of the bowl portion and an inner surface of the flow diverter on opposing side of the at least one attachment interface.

In a further non-limiting embodiment of any of the foregoing assemblies, the flow diverter comprises a solid bracket having a base wall that faces an external end face of the bowl portion and a side wall that extends from a periphery of the base wall in a direction toward the plurality of openings that form the reactor outlet.

In a further non-limiting embodiment of any of the foregoing assemblies, the side wall does not extend completely around the injection axis.

In a further non-limiting embodiment of any of the foregoing assemblies, the at least one attachment interface comprises a plurality of attachment interfaces between the flow diverter and the bowl portion.

In a further non-limiting embodiment of any of the foregoing assemblies, the flow diverter extends at least partially around the injection axis to surround at least a portion of the bowl portion, and including gaps between an outer surface of the bowl portion and an inner surface of the flow diverter on opposing sides of each attachment interface.

In a further non-limiting embodiment of any of the foregoing assemblies, the flow diverter comprises a solid bracket having a base wall that faces an external end face of the bowl portion and a side wall that extends from a periphery of the base wall in a direction toward the plurality of openings that form the reactor outlet, and wherein the side wall includes a radially inwardly extending indent for each attachment interface.

In a further non-limiting embodiment of any of the foregoing assemblies, the side wall does not extend completely around the injection axis.

In a further non-limiting embodiment of any of the foregoing assemblies, at least one additional attachment interface is between the mixer shell and the flow diverter.

A mixer assembly, according to yet another exemplary aspect of the present disclosure includes, among other things, a mixer shell defining an internal cavity, wherein the mixer shell includes an upstream end configured to receive exhaust gases and downstream end, and wherein the mixer shell includes a doser opening configured to receive a doser that injects fluid. A reactor is positioned within the internal cavity. The reactor has a reactor inlet that is aligned with the doser opening to receive injected fluid, at least one exhaust gas inlet to direct exhaust gas into the reactor, and a reactor outlet that directs a mixture of exhaust gas and fluid into the internal cavity. An inlet baffle is mounted to the upstream end of the mixer shell, the inlet baffle including at least one opening that directs one portion of the exhaust gas into the at least one exhaust gas inlet to the reactor and a plurality of bypass openings that direct a remaining portion of the exhaust gas to bypass entry into the reactor. An outlet baffle is mounted to the downstream end of the mixer shell, the outlet baffle including a plurality of mixer outlet openings. A flow diverter is associated with the reactor to direct exhaust gas bypassing the reactor to mix with the mixture exiting the reactor outlet prior to exiting from the plurality of mixer outlet openings of the outlet baffle.

In a further non-limiting embodiment of any of the foregoing assemblies, the reactor inlet defines an injection axis and the reactor outlet comprises a plurality of openings that are circumferentially spaced apart from each other about the injection axis, and wherein the reactor has a first end at the reactor inlet and extends along the injection axis to a second end comprising a bowl portion to define an open mixing chamber within the reactor between the first and second ends.

In a further non-limiting embodiment of any of the foregoing assemblies, the flow diverter comprises a solid bracket having a base wall that faces an external end face of the bowl portion and a side wall that extends from a periphery of the base wall in a direction toward the plurality of openings that form the reactor outlet.

In a further non-limiting embodiment of any of the foregoing assemblies, at least one attachment interface is between the flow diverter and the bowl portion, and wherein the flow diverter extends only partially around the injection axis to only surround a portion of the bowl portion, and including gaps between an outer surface of the bowl portion and an inner surface of the flow diverter on opposing side of the at least one attachment interface.

In a further non-limiting embodiment of any of the foregoing assemblies, the at least one attachment interface comprises a plurality of attachment interfaces between the flow diverter and the bowl portion, and wherein the gaps are between the outer surface of the bowl portion and the inner surface of the flow diverter on opposing sides of each attachment interface, and wherein the side wall includes a radially inwardly extending indent for each attachment interface.

In a further non-limiting embodiment of any of the foregoing assemblies, at least one additional attachment interface is between the mixer shell and the flow diverter.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

This disclosure details an exemplary mixer that achieves high mixing performance in a compact mixer configuration by using a flow diverter to redirect bypass flow that has warmed up a reactor mixing chamber in order to mix with flow exiting the mixing chamber prior to reaching an exhaust after-treatment catalyst.

Figure 1:
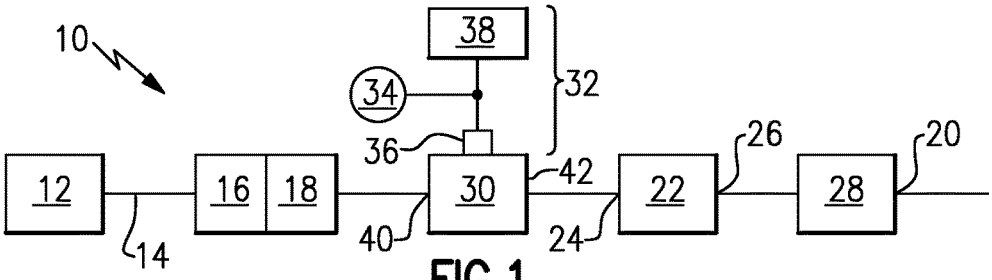
FIG. 1 schematically illustrates one example of an exhaust system according to the subject disclosure.

FIG. 1 shows a vehicle exhaust system 10 that conducts hot exhaust gases generated by an engine 12 through various exhaust components to reduce emission and control noise as known. In one example configuration, at least one pipe 14 directs engine exhaust gases exiting an exhaust manifold of the engine 12 into one or more exhaust gas aftertreatment components. In one example, the exhaust gas aftertreatment components include a diesel oxidation catalyst (DOC) 16, and an optional diesel particulate filter (DPF) 18 that is used to remove contaminants from the exhaust gas as known.

Downstream of the DOC 16 and optional DPF 18 is a selective catalytic reduction (SCR) catalyst 22 having an inlet 24 and an outlet 26. Optionally, component 22 can comprise a catalyst that is configured to perform a selective catalytic reduction function and a particulate filter function. The outlet 26 from the SCR 22 communicates exhaust gases to downstream exhaust components 28 and the exhaust gas eventually exits to atmosphere via a tailpipe 20. The various downstream exhaust components 28 can include one or more of the following: pipes, filters, valves, catalysts, mufflers etc. These exhaust system components can be mounted in various different configurations and combinations dependent upon vehicle application and available packaging space.

In one example, a mixer 30 is positioned downstream from an outlet of the DOC 16 or DPF 18 and upstream of the inlet 24 of the SCR 22. The DOC/DPF and SCR can be in-line or in parallel, for example. The mixer 30 is used to facilitate mixing of the exhaust gas.

An injection system 32 is used to inject a reducing agent, such as diesel exhaust fluid (DEF), for example, into the exhaust gas stream upstream from the SCR catalyst 22 such that the mixer 30 can mix the DEF and exhaust gas thoroughly together. The injection system 32 includes a fluid supply tank 34, a doser 36, and a controller 38 that controls injection of the fluid as known. In one example, the doser 36 injects the DEF into the mixer 30 as shown in FIG. 1.

A control system includes the controller 38 that controls injection of the DEF based on one or more of exhaust gas temperature, backpressure, time, etc. The controller 38 can be a dedicated electronic control unit or can be an electronic control unit associated with a vehicle system control unit or sub-system control unit. The controller 38 can include a processor, memory, and one or more input and/or output (I/O) device interface(s) that are communicatively coupled via a local interface. The controller 38 may be a hardware device for executing software, particularly software stored in memory.

Figure 2A:
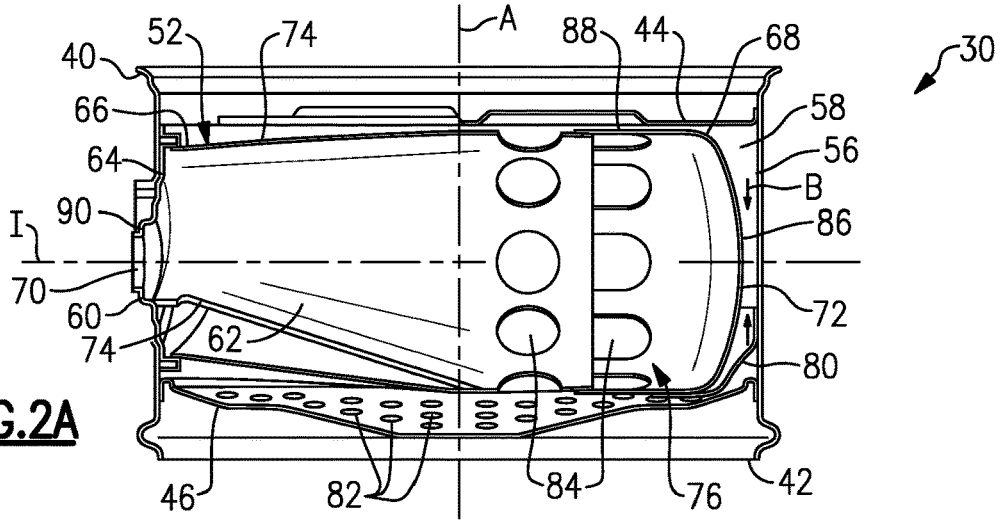
FIG. 2A is a side section view of a mixer with an inlet reactor and a flow diverter as used in the exhaust system of FIG. 1.
Figure 2B:
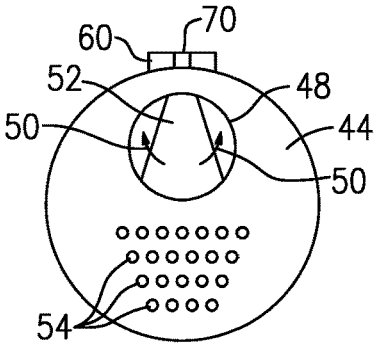
FIG. 2B is a schematic representation of an inlet baffle for the mixer of FIG. 2A.
Figure 2C:
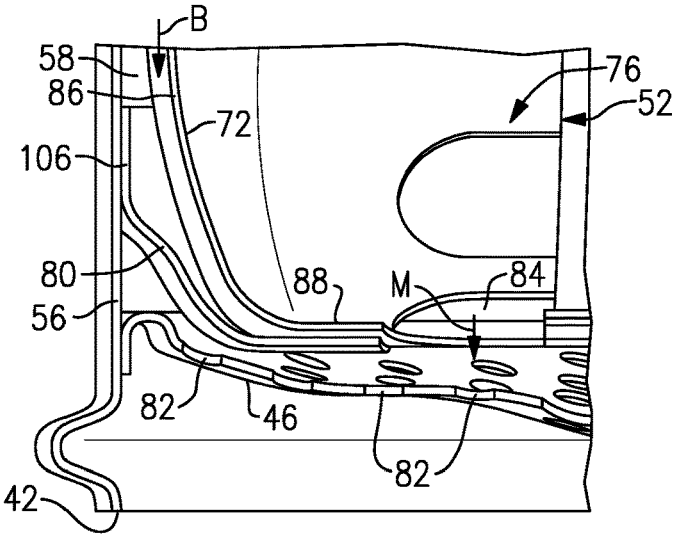
FIG. 2C is an enlarged detail of a section of FIG. 2A.

The mixer 30 is used to generate a swirling or rotary motion of the exhaust gas. The mixer 30 has an inlet end 40 configured to receive the engine exhaust gases and an outlet end 42 to direct a mixture of swirling engine exhaust gas and products transformed from the injected fluid to the SCR catalyst 22. FIGS. 2A-2C show one example of the mixer 30. The mixer 30 includes an inlet baffle 44 (FIGS. 2A and 2B) at the inlet end 40. An outlet baffle 46 (FIGS. 2A and 2C) is associated with the outlet end 42. In one example, the inlet baffle 44 includes at least one large inlet opening 48 that receives the majority of the exhaust gas and directs the exhaust gas into exhaust gas inlets 50 to an inlet reactor 52. The inlet baffle 44 also includes a plurality of perforations, slots, or additional inlet openings 54 that allow the remaining exhaust gas to bypass the inlet reactor 52 to facilitate optimal homogenization of exhaust gases and reduced back pressure. The exhaust gas that bypasses the inlet reactor 52 is also used to warm up a portion of the inlet reactor that is subject to deposit formation.

The inlet 44 and outlet 46 baffles are fixed to a mixer shell 56 that defines a mixer center axis A and provides an internal cavity 58 (FIG. 2A) between the inlet 44 and outlet 46 baffles. In one example, the baffles comprises stamped sheet metal parts. The inlet reactor 52 is located within the internal cavity 58. Exhaust gas and injected fluid spray, which is injected via the doser 36 into the inlet reactor 52, are mixed within the inlet reactor 52 and exit into the internal cavity 58 to mix with the bypass exhaust gas before exiting the mixer 30.

In one example, the inlet reactor 52 is used to facilitate mounting the doser 36 relative to the mixer shell 56. The inlet reactor 52 includes a doser mount portion 60 and a swirl chamber 62 that extends into the internal cavity 58. The doser mount portion 60 is mounted to the mixer shell 56 at a doser opening 64 formed within the mixer shell 56. The doser mount portion 60 is configured to support the doser 36 that injects a fluid into the swirl chamber 62 via a reactor inlet 70 that is aligned with the doser opening 64.

In one example, the swirl chamber 62 has a first end 66 at the doser opening 64 and a second end 68 at an outlet. In one example, the swirl chamber 62 is comprised of a plurality of flow elements 74 that are attached to each other to form an open internal area within the swirl chamber 62. An example of the inlet reactor 52 can be found in applicant's co-pending application Ser. No. 16/834,182 filed on Mar. 30, 2020 and herein incorporated by reference.

In one example, the inlet reactor 52 has the fluid inlet 70 and one or more exhaust gas inlets 50 (FIG. 2B). The fluid inlet 70 is aligned with the doser opening 64 and defines an injection axis I that is transverse to the mixer center axis A (FIG. 2A). In one example, the injection axis I is generally perpendicular to the mixer center axis A. The large inlet opening 48 of the inlet baffle 44 directs exhaust gas into the exhaust gas inlets 50 as shown in FIG. 2B. The plurality of bypass openings 54 direct exhaust gas to bypass entry into the inlet reactor 52. The bypassing exhaust gas B is used to warm a bowl portion 72 of the inlet reactor 52 that faces the reactor inlet 70.

In one example, the inlet reactor 52 extends along the injection axis I from the first end 66 at the fluid inlet 70 to the second end 68 that includes a reactor outlet 76. In one example, the bowl portion 72 comprises an end cap that encloses the second end 68 of the inlet reactor 52. The reactor outlet 76 directs a mixture of exhaust gas and injected fluid into the internal cavity 58 as indicated by arrow M in FIG. 2C.

A flow diverter 80 is associated with the reactor 52 to direct exhaust gas B bypassing the reactor 52 to mix with the mixture M exiting the reactor outlet 76 prior to exiting the downstream end 42 of the mixer 30. The bypassing exhaust gas B and the mixture M mix together and then exit the outlet baffle 46 via a plurality of outlet baffle openings 82 as shown in FIG. 2C.

In one example, the reactor outlet 76 comprises a plurality of openings 84 that are circumferentially spaced apart from each other about the injection axis I. The reactor 52 extends along the injection axis from the first end 66 to the second end 68 that includes the bowl portion 72. This provides an open mixing or swirl chamber 62 within the reactor 52 between the first 66 and second 68 ends.

In one example, the bowl portion 72 comprises a solid base surface 86, e.g. a surface free from openings, that faces the inlet 70 and that includes a peripheral wall 88 extending about a periphery of the solid base surface 86 and extending toward the fluid inlet 70. In one example, the peripheral wall 88 includes the reactor outlet openings 84 through which the mixture M of fluid and exhaust gas exits the inlet reactor 52 to mix with bypass flow B from the bypass openings 54.

In one example, the inlet reactor 52 has a smaller cross-section at the first end 66 than at the second end 68 to form a conical shape. In one example, the doser mount portion 60 at the first end 66 includes a center boss 90 with the fluid inlet 70 that defines the injection axis I.

Figure 3:
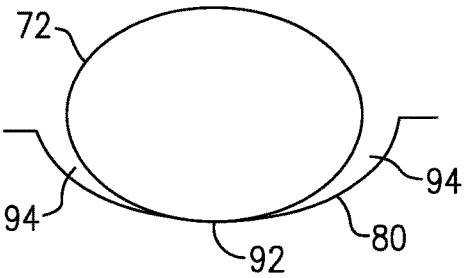
FIG. 3 is a schematic view of an attachment between the flow diverter and inlet reactor of FIG. 2A.
Figure 4B:
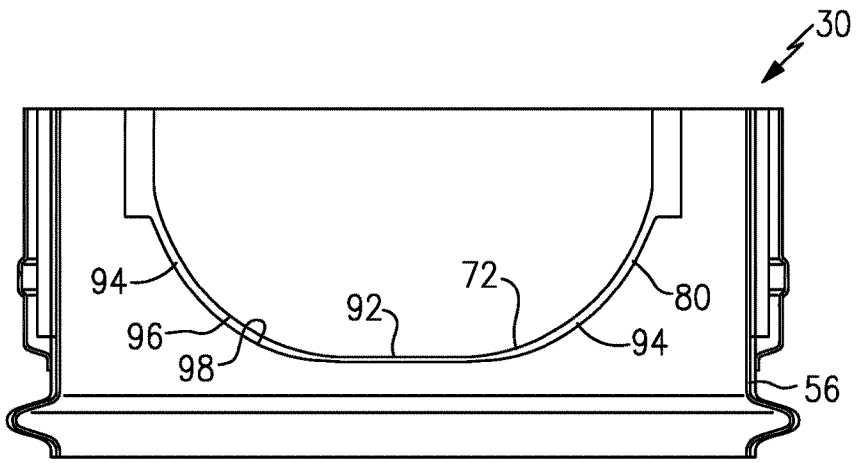
FIG. 4B is one section view of the flow diverter and bowl of FIG. 4A.
Figure 4C:
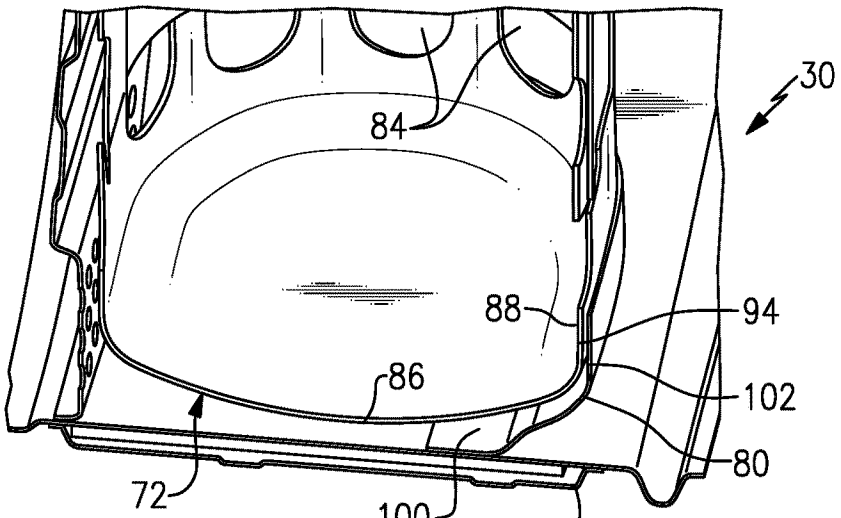
FIG. 4C is another section view of the flow diverter and bowl of FIG. 4A.
Figure 4A:
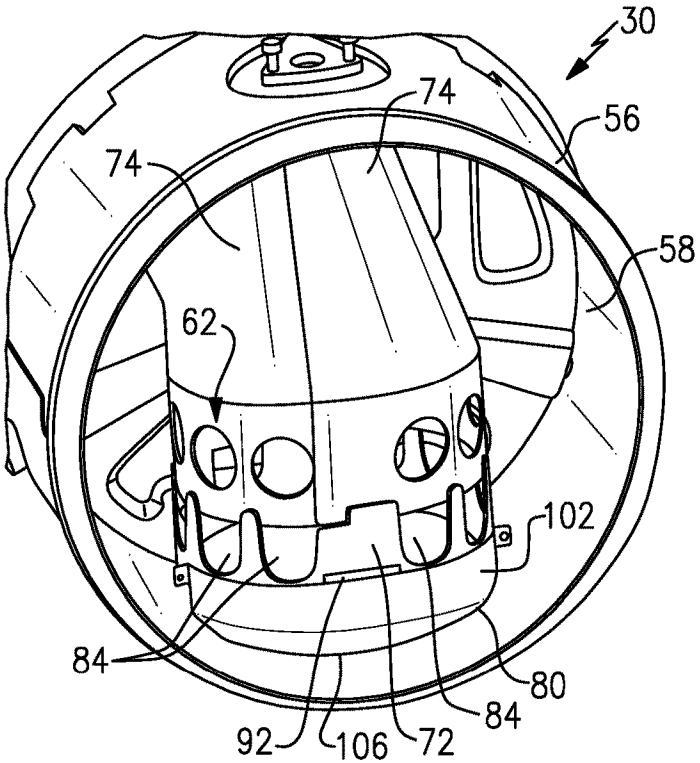
FIG. 4A is perspective view of an attachment between one example of a flow diverter and a bowl of the inlet reactor.

As shown in FIG. 3, there is at least one attachment interface 92 between the flow diverter 80 and the bowl portion 72. FIGS. 4A-4C show this example in greater detail. The flow diverter extends at least partially around the injection axis I to surround at least a portion of the bowl portion 72. In this example, there is only one attachment interface 92, which is positioned between a pair of adjacent reactor outlet openings 84. In one example, this attachment interface 92 comprises a weld that provides for a secure connection between the flow diverter 80 and the bowl portion 72. There are gaps 94 between an outer surface 96 of the bowl portion 72 and an inner surface 98 of the flow diverter 80 on opposing side of the attachment interface 92 as shown in FIG. 4B. These gaps 94 direct the bypass exhaust gas flow B directly toward the mixed flow M exiting the inlet reactor 52 as best shown in FIG. 2C.

Figure 5A:
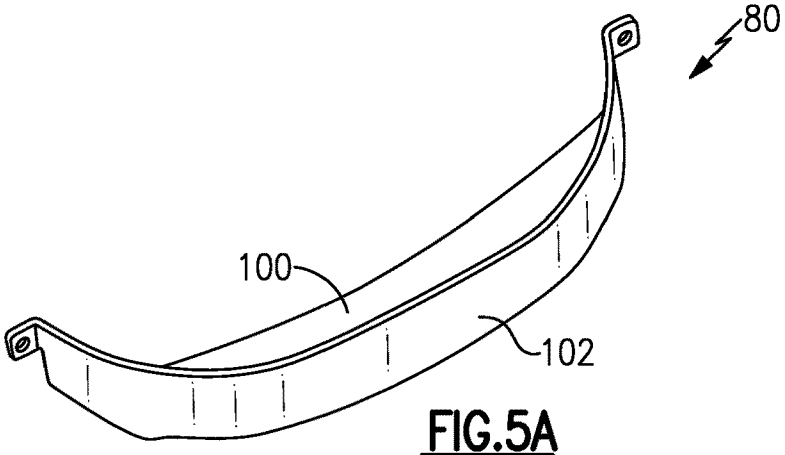
FIG. 5A is a perspective view of one side of the flow diverter of FIG. 4A.
Figure 5B:
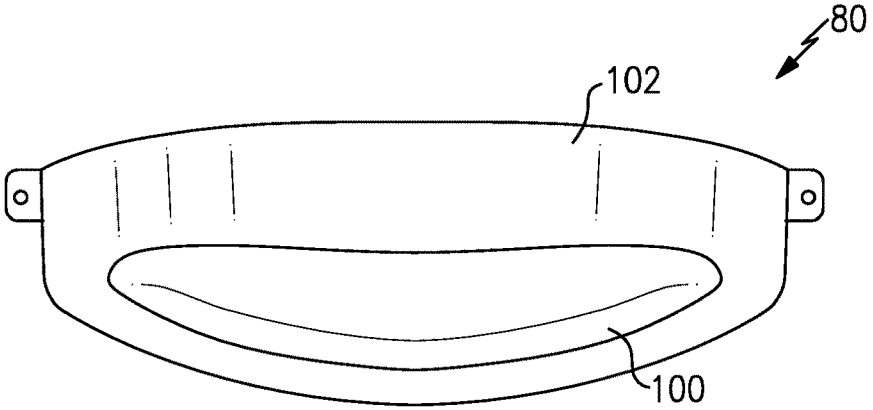
FIG. 5B is a perspective view of an opposite side of the flow diverter of FIG. 5A.

The flow diverter 80 is shown in greater detail in FIGS. 5A-5B. In this example, the flow diverter 80 comprises a solid bracket body having a base wall 100 that faces the outer surface 96 of the bowl portion 72 and a side wall 102 that extends from a periphery of the base wall 100 in a direction toward the plurality of openings 84 that form the reactor outlet 76.

In one example, the side wall 102 of the flow diverter 80 does not extend completely around the injection axis I and bowl portion 72. In other words, the side wall 102 only extends partially about the bowl portion 72. In one example, the flow diverter 80 extends with a range of 60 degrees to 180 degrees about an outer circumference of the bowl portion 72.

Figure 6B:
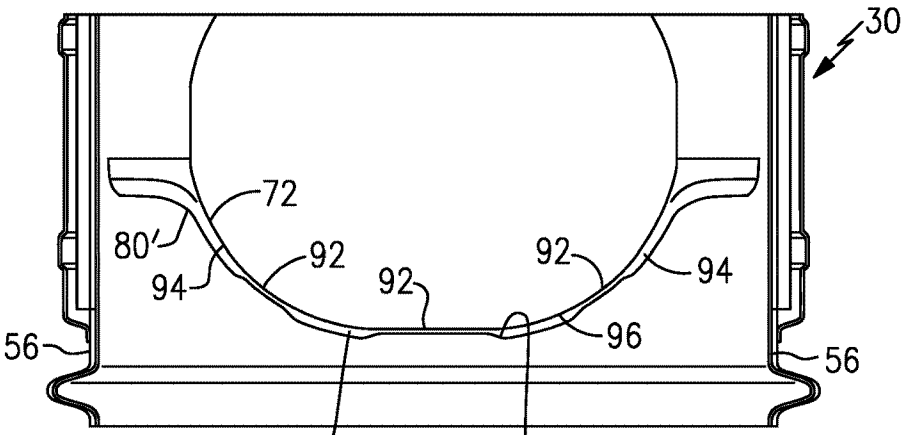
FIG. 6B is one section view of the flow diverter and bowl of FIG. 6A.
Figure 6C:
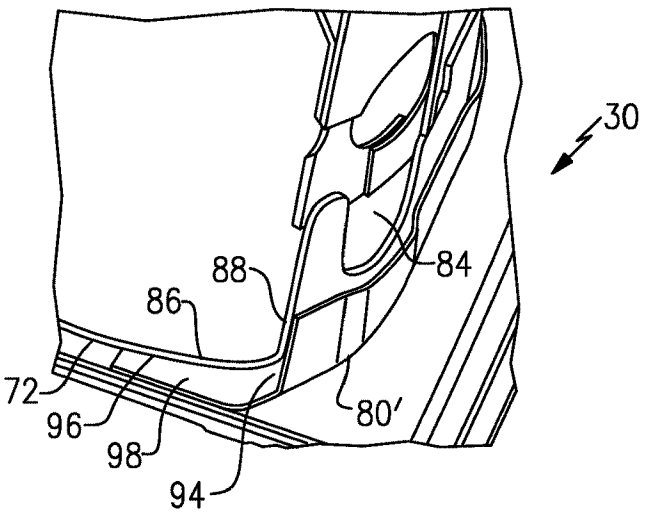
FIG. 6C is another section view of the flow diverter and bowl of FIG. 6A.
Figure 6A:
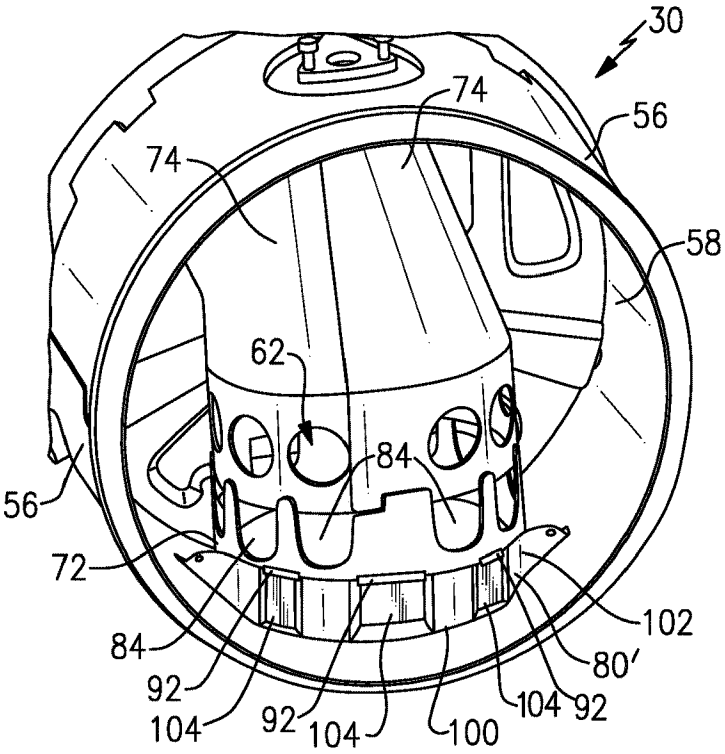
FIG. 6A is perspective view of an attachment between another example of a flow diverter and a bowl of the inlet reactor.

In another example, shown in FIGS. 6A-6C, there a plurality of attachment interfaces 92 between the flow diverter 80' and the bowl portion 72. Each attachment interface 92 is positioned between a pair of adjacent reactor outlet openings 84. In one example, the attachment interfaces 92 comprise welds that provide for a secure connection between the flow diverter 80' and the bowl portion 72. There are gaps 94 between the outer surface 96 of the bowl portion 72 and the inner surface 98 of the flow diverter 80' on opposing sides of each of the attachment interfaces 92 as shown in FIG. 6B. These gaps 94 direct the bypass exhaust gas flow B directly toward the mixed flow M exiting the inlet reactor 52 as best shown in FIG. 2C.

Figure 7A:
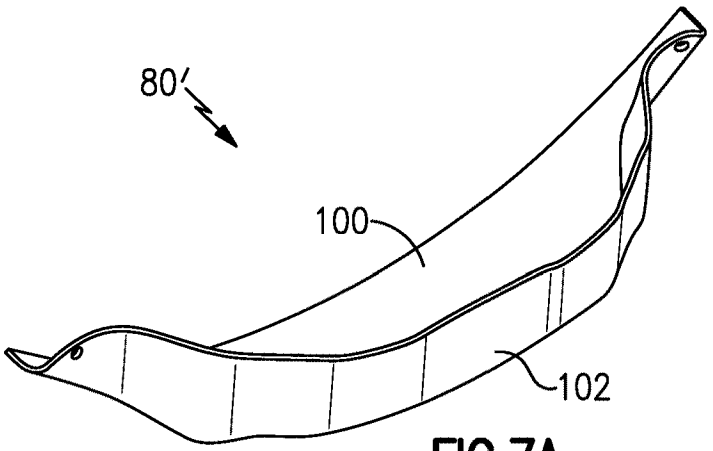
FIG. 7A is a perspective view of one side of the flow diverter of FIG. 6A.
Figure 7B:
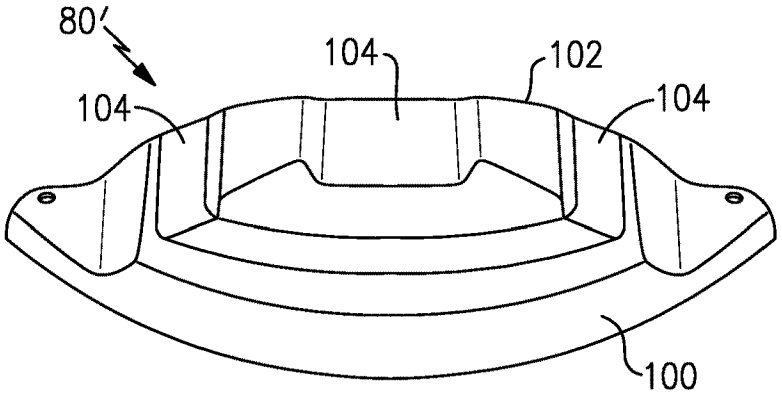
FIG. 7B is a perspective view of an opposite side of the flow diverter of FIG. 7A.

The flow diverter 80' is shown in greater detail in FIGS. 7A-7B. In this example, the side wall 102 includes a radially inwardly extending indent 104 for each attachment interface 92 as best shown in FIG. 7B. In one example, the side wall 102 of the flow diverter 80' does not extend completely around the injection axis I and only extends partially about the bowl portion 72. In one example, the flow diverter extends with a range about an outer circumference of the bowl portion 72 that is similar to the configuration shown in FIGS. 5A-5B.

In either configuration, the mixer 30 can includes at least one additional attachment interface 106 between the mixer shell 56 and the flow diverter 80. 80', which is best shown in FIG. 2C. Adding a connection or attachment interface 106 between the reactor 52 and the mixer shell 56 adds strength for increased durability. In one example, this interface 106 comprises a weld.

It is known to use a portion of the exhaust flow to warm up impingement areas of the mixer 30. The impingement areas comprise areas when the likelihood of deposit formation is increased. The portion of exhaust gas flow for warming is directed to bypass a main mixing chamber and therefore the concentration of ammonia produced by the hydrolysis of urea in this bypass flow is low or non-existent. When this bypass flow reaches the SCR it can contribute to low mixing performance. The subject disclosure uses a flow diverter to redirect the bypass flow that warms up the mixing chamber in order to mix with high ammonia concentration flow prior to reaching the SCR catalyst. Further, the flow diverter is welded to the inlet reactor to add strength for increased durability. Thus, subject disclosure provides a compact mixer configuration that allows the bypass flow to warm the bowl portion and to reduce backpressure, while also achieving a high mixing performance due to the remix of the bypass flow into the mixture flow before exiting the mixer.

Although a specific component relationship is illustrated in the figures of this disclosure, the illustrations are not intended to limit this disclosure. In other words, the placement and orientation of the various components shown could vary within the scope of this disclosure. In addition, the various figures accompanying this disclosure are not necessarily to scale, and some features may be exaggerated or minimized to show certain details of a particular component.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

The invention claimed is:

1. A mixer assembly for a vehicle exhaust system comprising:

a mixer shell defining an internal cavity, wherein the mixer shell includes an upstream end configured to receive exhaust gases and downstream end;

a reactor positioned within the internal cavity, the reactor having a first end with a reactor inlet configured to receive injected fluid and a second end with a reactor outlet that directs a mixture of exhaust gas and injected fluid into the internal cavity, the second end being spaced apart from an inner surface of the mixer shell, and wherein the reactor inlet defines an injection axis and the reactor outlet comprises a plurality of openings that are circumferentially spaced apart from each other about the injection axis; and a flow diverter associated with the reactor to direct exhaust gas bypassing the reactor to mix with the mixture of exhaust gas and injected fluid exiting the reactor outlet prior to exiting the downstream end of the mixer shell.

2. The mixer assembly according to claim 1, including an inlet baffle mounted to the upstream end of the mixer shell, the inlet baffle including at least one opening that directs exhaust gas into at least one exhaust gas inlet to the reactor and a plurality of bypass openings that direct exhaust gas to bypass entry into the reactor.

3. The mixer assembly according to claim 2, including an outlet baffle mounted to the downstream end of the mixer shell, the outlet baffle including a plurality of mixer outlet openings.

4. The mixer assembly according to claim 2, wherein the reactor extends along the injection axis from the first end to the second end which comprises a bowl portion to define an open mixing chamber within the reactor between the first end and the second end, and wherein the bowl portion is spaced apart from the inner surface of the mixer shell.

5. The mixer assembly according to claim 4, wherein the reactor comprises a conical shape having a larger cross-section at the second end than at the first end, and wherein the bowl portion comprises a solid surface that faces the reactor inlet.

6. The mixer assembly according to claim 4, including at least one attachment interface between the flow diverter and the bowl portion.

7. The mixer assembly according to claim 6, wherein the flow diverter extends at least partially around the injection axis to surround at least a portion of the bowl portion, and including gaps between an outer surface of the bowl portion and an inner surface of the flow diverter on opposing side of the at least one attachment interface.

8. The mixer assembly according to claim 7, wherein the flow diverter comprises a solid bracket having a base wall that faces an external end face of the bowl portion and a side wall that extends from a periphery of the base wall in a direction toward the plurality of openings that form the reactor outlet.

9. The mixer assembly according to claim 8, wherein the side wall does not extend completely around the injection axis.

10. The mixer assembly according to claim 7, including at least one additional attachment interface between the mixer shell and the flow diverter.

11. The mixer assembly according to claim 6, wherein the at least one attachment interface comprises a plurality of attachment interfaces between the flow diverter and the bowl portion.

12. The mixer assembly according to claim 11, wherein the flow diverter extends at least partially around the injection axis to surround at least a portion of the bowl portion, and including gaps between an outer surface of the bowl portion and an inner surface of the flow diverter on opposing sides of each attachment interface.

13. The mixer assembly according to claim 12, wherein the flow diverter comprises a solid bracket having a base wall that faces an external end face of the bowl portion and a side wall that extends from a periphery of the base wall in a direction toward the plurality of openings that form the reactor outlet, and wherein the side wall includes a radially inwardly extending indent for each attachment interface.

14. The mixer assembly according to claim 13, wherein the side wall does not extend completely around the injection axis.

15. The mixer assembly according to claim 4, wherein the bowl portion is spaced apart from the inner surface of the mixer shell by a gap to allow bypassing exhaust gas to flow between a solid base surface of the bowl portion and the inner surface of the mixer shell.

16. The mixer assembly according to claim 1, wherein the flow diverter comprises a base wall that faces the second end of the reactor and a side wall that extends from a periphery of the base wall in a direction toward the plurality of openings, and wherein the base wall does not intersect the injection axis.

17. The mixer assembly according to claim 16, wherein the side wall extends only partially about the injection axis and has a first surface facing an outer surface of the reactor and a second surface facing an inner surface of an outlet baffle mounted to a downstream end of the mixer shell, and/or including at least one attachment interface between the second end of the reactor and the flow diverter which is positioned between a pair of adjacent reactor outlet openings of the plurality of openings.

18. A mixer assembly for a vehicle exhaust system comprising:

a mixer shell defining an internal cavity, wherein the mixer shell includes an upstream end configured to receive exhaust gases and downstream end, and wherein the mixer shell includes a doser opening configured to receive a doser that injects fluid;

a reactor positioned within the internal cavity, the reactor having a first end with a reactor inlet that is aligned with the doser opening to receive injected fluid, at least one exhaust gas inlet to direct exhaust gas into the reactor, and a second end with a reactor outlet that directs a mixture of exhaust gas and fluid into the internal cavity, wherein the second end is spaced apart from an inner surface of the mixer shell, and wherein the reactor inlet defines an injection axis and the reactor outlet comprises a plurality of openings that are circumferentially spaced apart from each other about the injection axis;

an inlet baffle mounted to the upstream end of the mixer shell, the inlet baffle including at least one opening that directs one portion of the exhaust gas into the at least one exhaust gas inlet to the reactor and a plurality of bypass openings that direct a remaining portion of the exhaust gas to bypass entry into the reactor;

an outlet baffle mounted to the downstream end of the mixer shell, the outlet baffle including a plurality of mixer outlet openings; and a flow diverter associated with the reactor to direct exhaust gas bypassing the reactor to mix with the mixture of exhaust gas and injected fluid exiting the reactor outlet prior to exiting from the plurality of mixer outlet openings of the outlet baffle.

19. The mixer assembly according to claim 18, wherein the reactor extends along the injection axis from the first end to the second end which comprises a bowl portion to define an open mixing chamber within the reactor between the first end and the second end, and wherein the bowl portion is spaced apart from the inner surface of the mixer shell.

20. The mixer assembly according to claim 19, wherein the bowl portion is spaced apart from the inner surface of the mixer shell by a gap to allow bypassing exhaust gas to flow between a solid base surface of the bowl portion and the inner surface of the mixer shell.

21. The mixer assembly according to claim 18, wherein the flow diverter comprises a base wall that faces the second end of the reactor and a side wall that extends from a periphery of the base wall in a direction toward the plurality of openings, and wherein the base wall does not intersect the injection axis.

22. The mixer assembly according to claim 21, wherein the side wall extends only partially about the injection axis and has a first surface facing an outer surface of the reactor and a second surface facing an inner surface of an outlet baffle mounted to a downstream end of the mixer shell, and/or including at least one attachment interface between the second end of the reactor and the flow diverter which is positioned between a pair of adjacent reactor outlet openings of the plurality of openings.

23. A mixer assembly for a vehicle exhaust system comprising:

a mixer shell defining an internal cavity, wherein the mixer shell includes an upstream end configured to receive exhaust gases and downstream end, and wherein the mixer shell includes a doser opening configured to receive a doser that injects fluid;

a reactor positioned within the internal cavity, the reactor having a reactor inlet that is aligned with the doser opening to receive injected fluid, at least one exhaust gas inlet to direct exhaust gas into the reactor, and a reactor outlet that directs a mixture of exhaust gas and fluid into the internal cavity, wherein the reactor inlet defines an injection axis and the reactor outlet comprises a plurality of openings that are circumferentially spaced apart from each other about the injection axis, and wherein the reactor has a first end at the reactor inlet and extends along the injection axis to a second end comprising a bowl portion to define an open mixing chamber within the reactor between the first and second ends;

an inlet baffle mounted to the upstream end of the mixer shell, the inlet baffle including at least one opening that directs one portion of the exhaust gas into the at least one exhaust gas inlet to the reactor and a plurality of bypass openings that direct a remaining portion of the exhaust gas to bypass entry into the reactor;

an outlet baffle mounted to the downstream end of the mixer shell, the outlet baffle including a plurality of mixer outlet openings; and a flow diverter associated with the reactor to direct exhaust gas bypassing the reactor to mix with the mixture exiting the reactor outlet prior to exiting from the plurality of mixer outlet openings of the outlet baffle, wherein the flow diverter comprises a solid bracket having a base wall that faces an external end face of the bowl portion and a side wall that extends from a periphery of the base wall in a direction toward the plurality of openings that form the reactor outlet.

24. The mixer assembly according to claim 23, including at least one attachment interface between the flow diverter and the bowl portion, and wherein the flow diverter extends only partially around the injection axis to only surround a portion of the bowl portion, and including gaps between an outer surface of the bowl portion and an inner surface of the flow diverter on opposing side of the at least one attachment interface.

25. The mixer assembly according to claim 24, wherein the at least one attachment interface comprises a plurality of attachment interfaces between the flow diverter and the bowl portion, and wherein the gaps are between the outer surface of the bowl portion and the inner surface of the flow diverter on opposing sides of each attachment interface, and wherein the side wall includes a radially inwardly extending indent for each attachment interface.

26. The mixer assembly according to claim 24, including at least one additional attachment interface between the mixer shell and the flow diverter.

* * * * *